US008955894B2

(12) United States Patent
Parker

(10) Patent No.: US 8,955,894 B2
(45) Date of Patent: Feb. 17, 2015

(54) ADJUSTABLE SPREADER BAR SYSTEM

(75) Inventor: Adam Parker, Soda Springs, ID (US)

(73) Assignee: NC Services Group, Ltd., Edmonton, Alberta (CA)

( * ) Notice: Subject to any disclaimer, the term of this patent is extended or adjusted under 35 U.S.C. 154(b) by 212 days.

(21) Appl. No.: 13/421,332

(22) Filed: Mar. 15, 2012

(65) Prior Publication Data

US 2013/0020818 A1 Jan. 24, 2013

Related U.S. Application Data

(60) Provisional application No. 61/508,953, filed on Jul. 18, 2011, provisional application No. 61/590,197, filed on Jan. 24, 2012.

(51) Int. Cl.
*B66C 1/10* (2006.01)
*B66B 1/16* (2006.01)

(52) U.S. Cl.
CPC .... *B66C 1/10* (2013.01); *B66B 1/16* (2013.01)
USPC ..... 294/81.5; 294/81.1

(58) Field of Classification Search
USPC ..... 294/81.5, 82.1, 81.1, 81.2, 81.3, 81.55, 294/82.11, 82.12
See application file for complete search history.

(56) References Cited

U.S. PATENT DOCUMENTS

| | | | | |
|---|---|---|---|---|
| 2,987,340 | A * | 6/1961 | Mattera | 294/81.2 |
| 3,343,861 | A | 9/1967 | Sinicki | |
| 3,561,810 | A | 2/1971 | Newsted | |
| 3,749,437 | A | 7/1973 | Lynn | |
| 4,010,971 | A | 3/1977 | Kuwamoto et al. | |
| 4,462,627 | A | 7/1984 | Kudlicka | |
| 4,626,012 | A | 12/1986 | Weldele | |
| 4,736,975 | A * | 4/1988 | Perez et al. | 294/81.55 |
| 5,411,306 | A | 5/1995 | Campbell et al. | |
| 5,603,544 | A * | 2/1997 | Bishop et al. | 294/81.1 |
| 5,660,422 | A | 8/1997 | Knisley | |
| 5,820,184 | A | 10/1998 | Echenay | |
| 5,863,085 | A | 1/1999 | Khachaturian | |
| 6,062,620 | A | 5/2000 | Walker et al. | |
| 6,296,288 | B1 | 10/2001 | Khachaturian | |
| 7,677,623 | B2 | 3/2010 | Bath et al. | |
| 2001/0055523 | A1 * | 12/2001 | Slodden et al. | 414/458 |
| 2003/0222468 | A1 * | 12/2003 | Brooks | 294/81.5 |
| 2004/0164572 | A1 | 8/2004 | Bath et al. | |
| 2009/0273200 | A1 | 11/2009 | Grizzle | |

FOREIGN PATENT DOCUMENTS

| | | |
|---|---|---|
| WO | WO9903942 | 4/1990 |

* cited by examiner

*Primary Examiner* — Paul T Chin
(74) *Attorney, Agent, or Firm* — Jones Walker, LLP

(57) ABSTRACT

In the crane industry, there is a need to efficiently attach, move, and unattach loads to crane hooks. When the load has an asymmetrical center of gravity, two cranes are often used to move the load. In the specification and drawings a spreader bar assembly is described and shown with at least two longitudinal members having a length; a plurality of cross members each attaching to at least two longitudinal members; and a plurality of support means adjustably positioned along the length of the longitudinal members. In a preferable embodiment of the invention, a single crane uses a spreader bar assembly to move a load having an asymmetrical center of gravity.

28 Claims, 4 Drawing Sheets

ADJUSTABLE SPREADER BAR SYSTEM

CROSS-REFERENCE TO RELATED APPLICATION

This application claims the benefit of U.S. Provisional Application Nos. 61/508,953, filed on Jul. 18, 2011, and 61/590,197, filed on Jan. 24, 2012, both of which are hereby incorporated by reference.

BACKGROUND

Cranes are often used to move heavy loads from one location to another. When more than one load needs to be moved consecutively, a significant amount of time is expended attaching and unattaching the crane's rigging to each load. Furthermore, when using traditional methods to move a load having an off-set center of gravity, several lengths of rigging hardware and multiple cranes are typically required. This multiple-crane technique has several disadvantages. First, it is time consuming to attach (and later unattach) multiple riggings to a load. Second, multiple riggings adds to the overall weight of the load, which in turn requires cranes with relatively higher capacity values. Third, moving the load with multiple cranes requires cranes with relatively longer boom lengths. And finally, using multiple cranes to move a single load is more expensive than if only one of them is needed to do the same job.

SUMMARY OF SELECTED EMBODIMENTS OF THE INVENTION

One embodiment of the invention is a spreader bar assembly, described in greater detail below, has two longitudinal members connected by a plurality of cross members. A plurality of adjustable support members are capable of being variably attached along the length of the longitudinal members. The support members are attached to support lines that are in turn attached to a load. As compared to traditional riggings, the ability of the support members to be repositioned along the length of the longitudinal members facilitates attachment of a load to a crane, especially when subsequent loads have varying points of attachment. Each support member is preferably repositioned substantially vertically from a load's point of attachment.

In preferred embodiments, one crane is needed to lift a load having an asymmetrical center of gravity because the spreader bar assembly allows the crane's hook to be positioned above the load's center of gravity. Although the spreader bar assembly could also be used with the traditional multiple-crane technique, using a single crane allows for greater mobility for placement of the load.

DETAILED DESCRIPTION

Figure 1:
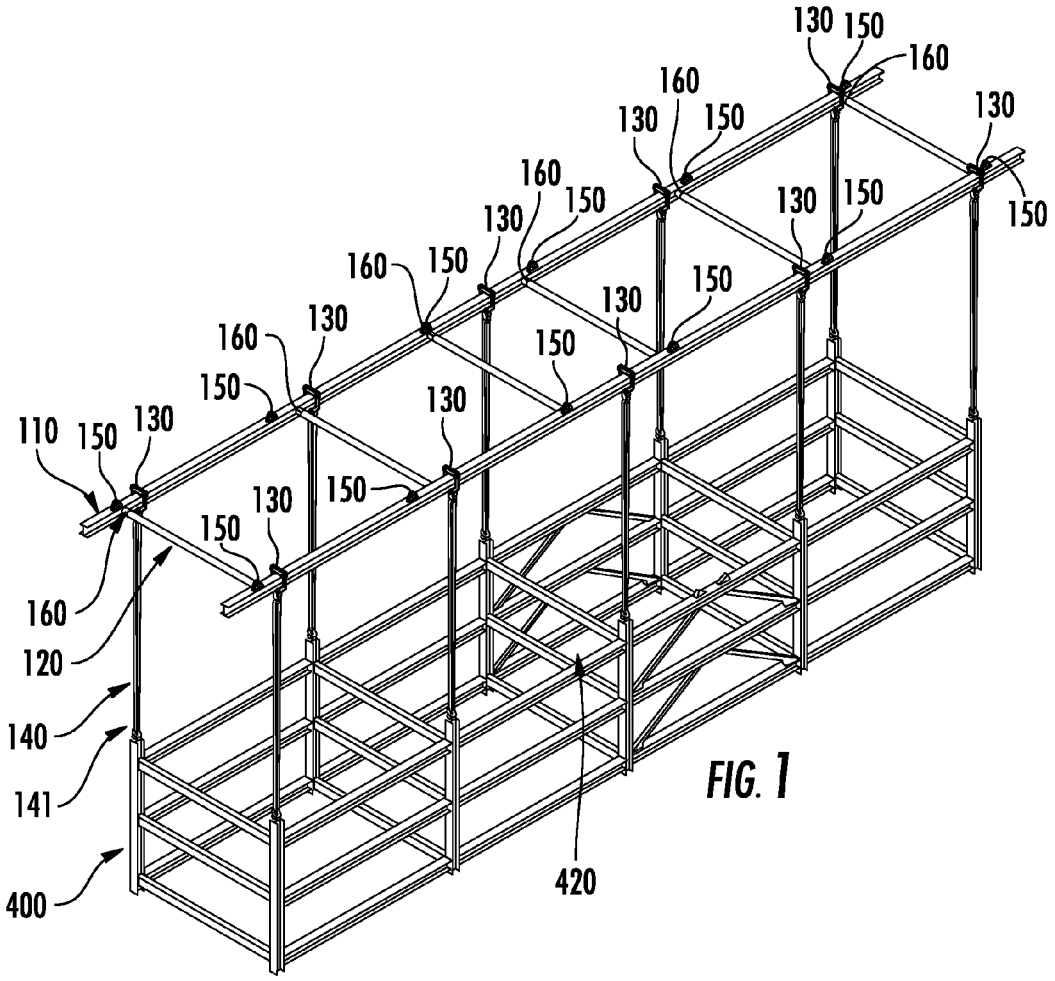
FIG. 1 is a perspective view of one embodiment of the spreader bar assembly.
Figure 2B:
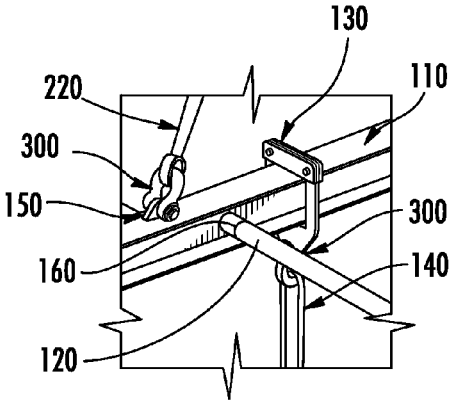
FIG. 2B is a detail view of FIG. 2A.
Figure 2A:
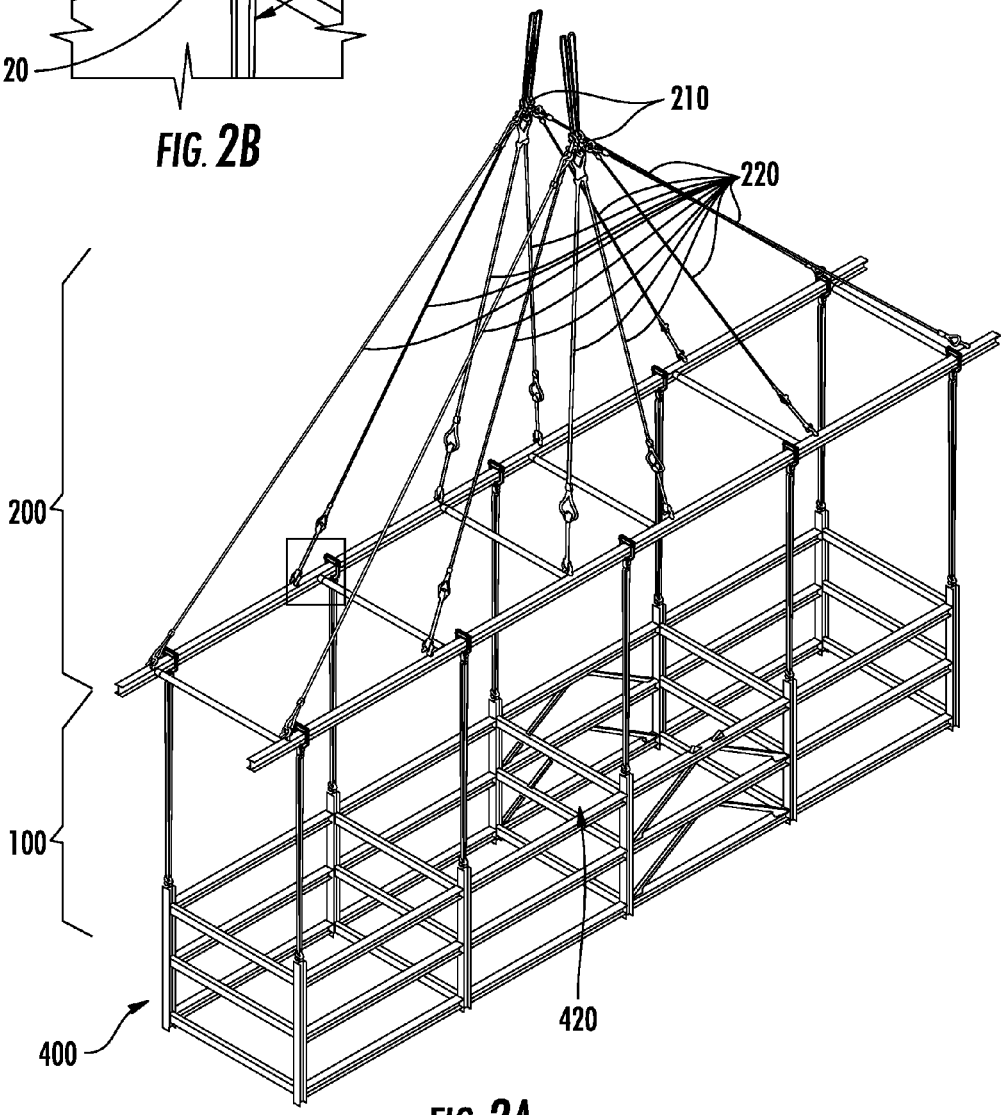
FIG. 2A is a perspective view of the spreader bar assembly of FIG. 1.

An embodiment of the invention is a spreader bar assembly. As shown in FIGS. 1 and 2, the spreader bar assembly 100 comprises a plurality of longitudinal members 110, a plurality of cross members 120 each engaging two or more longitudinal members 110, and a plurality of support members that are variably attached along the length of the longitudinal members 110 such that the location of the support members along the length of the longitudinal members 100 is not permanently fixed but is adjustable. A preferred embodiment of a support member is a frame 130.

In preferred embodiments, the longitudinal members 110 are I-beams, however other elongated rigid structures of various cross-sections may be suitable including tubular members or other extruded shapes. Likewise, cross members 120 preferably have a tubular cross-section, however other rigid structures of various cross-sections may be suitable including I-beams or other extruded shapes. As shown, cross members 120 are preferably engaged to a plurality of longitudinal members 110 such that they are substantially in the same plane. In alternative embodiments, the cross members 120 may be curved substantially within or without the plane of the longitudinal members 110. However, when the ends of cross members engage the longitudinal members, this should be considered substantially in the same plane. Longitudinal members 110 preferably comprise sleeves 160 which engage cross members 120. As a non-limiting example of an alternative embodiment comprising three longitudinal members, cross members may engage just two longitudinal members, or, alternatively, cross members may engage all three longitudinal members.

Figure 3:
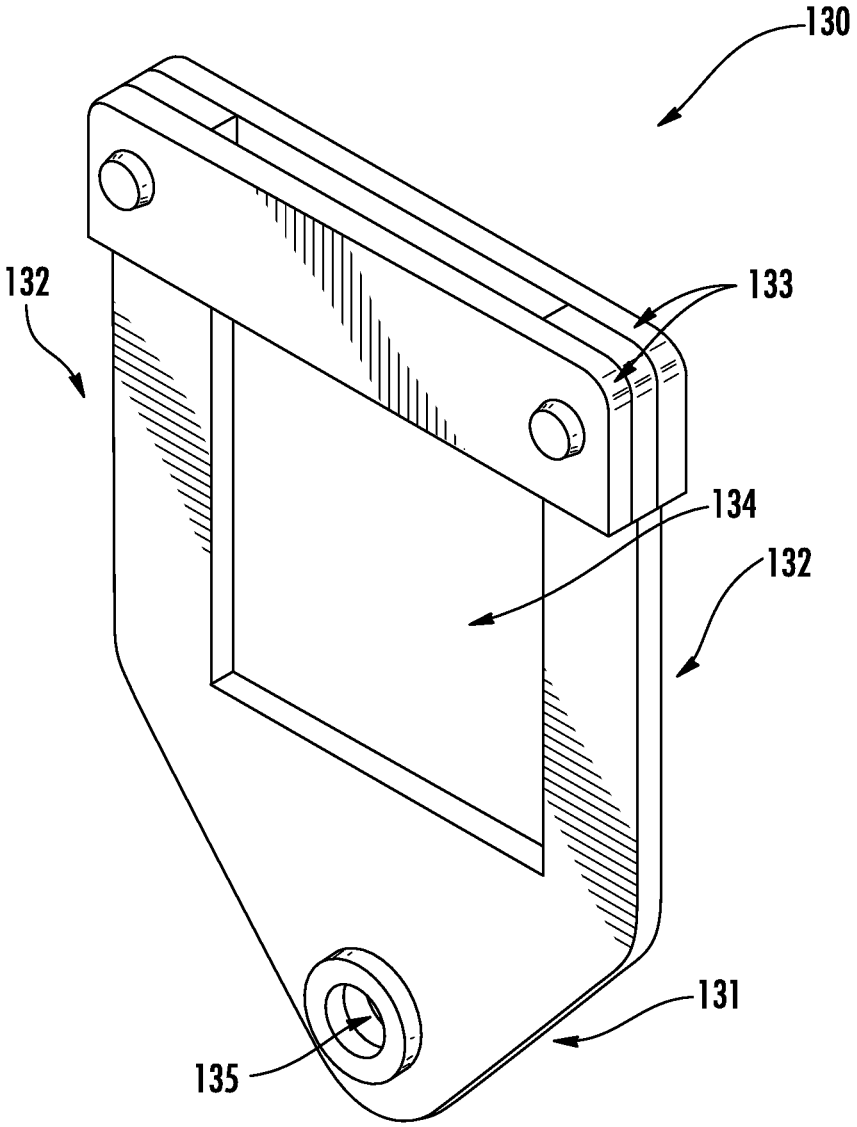
FIG. 3 is a perspective view of an embodiment of a frame.

A support member may be a frame 130 slidably attached to a longitudinal member 110. As shown in FIG. 3, a frame 130 comprises a U-shaped member comprising a base 131 and two arms 132. The base 131 preferably comprises an aperture facilitating the direct attachment of a shackle 300 to the base 131. The frame 130 further comprises one or more bar members 133 that, once attached to the frame arms 132, enclose an aperture within the frame 130. The aperture is preferably sized to be equal to or greater than the cross-section of the longitudinal member 110 to facilitate the adjustability of the frame 130 along the length of the longitudinal member 110. As shown, the aperture of the frame 130 is rectangularly shaped so that it can be adjustably positioned along the length of an I-beam longitudinal member 110. As an alternative non-limiting example, if the chosen cross-section of a longitudinal member was tubular, then the aperture of the frame would preferably be annular, which could be achieved through the used of a curved bar member and a suitably shaped U-shaped member.

Figure 4B:
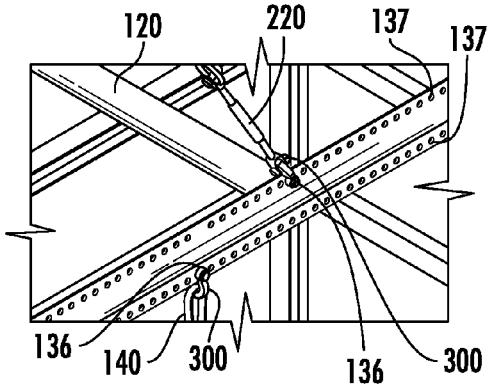
FIG. 4B is a detail view of FIG. 4A.
Figure 4A:
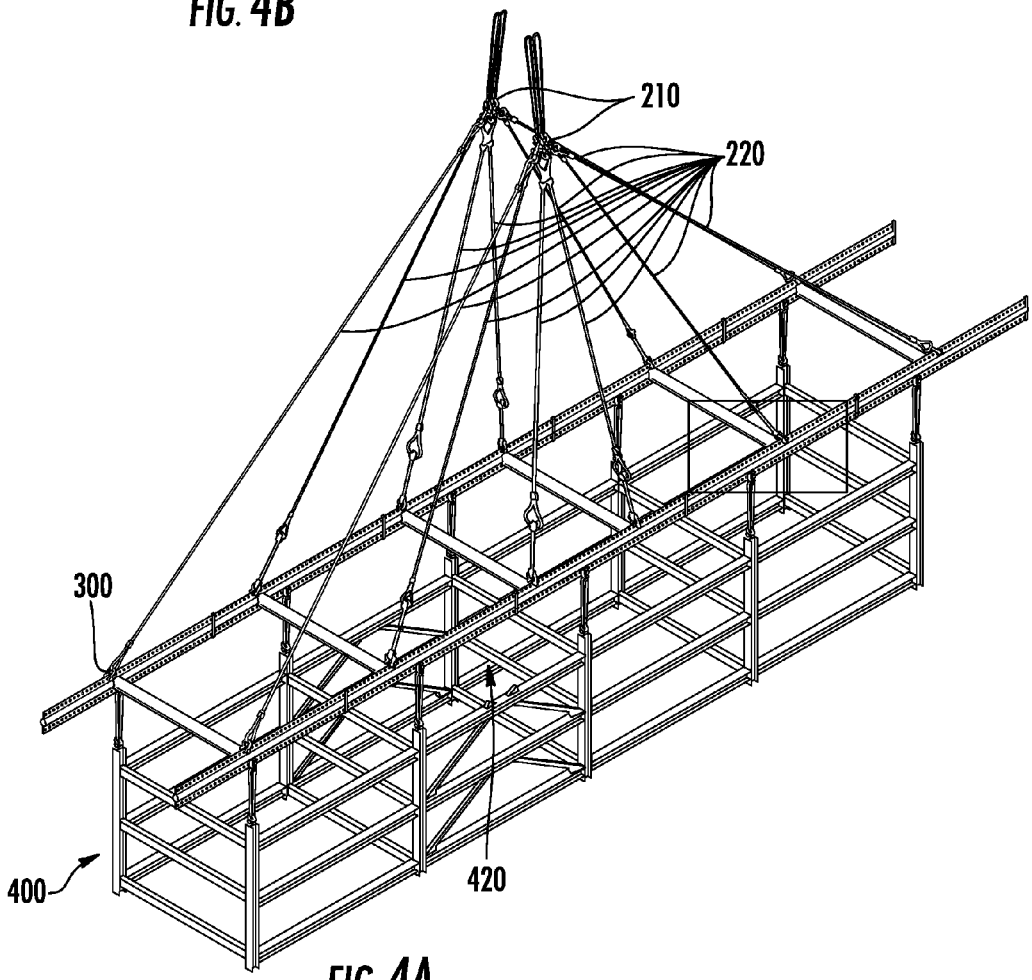
FIG. 4A is a perspective view of another embodiment of the spreader bar assembly.

As shown in FIGS. 4A and 4B, alternative support members include pegs 136 that allow for variable attachment along the length of a longitudinal member 110 through a plurality of slots 137 through the longitudinal member. Further non-limiting alternatives encompassing a support member include strap, hook, or hanger designs.

In an embodiment, a shackle 300 may be used to attach a support line 140 to a frame 130. A preferable method of moving a load with a crane comprises positioning the spreader bar assembly 110 above a load 400, sliding or otherwise adjustably positioning support members, e.g., frames 130, vertically above the attachment points of the load 400, and attaching the free ends of the support lines 140 to the load 400. The crane hook is preferably positioned vertically above the center of gravity of the load 400. The length of the spreader bar assembly 100 may be different from the load 400. A preferable number of support lines 140 to be attached to a load 400 is at least four and more preferably at least eight or more. In one embodiment support lines 140 are endless slings.

An embodiment of the spreader bar assembly 100 comprises overhead rigging 200 and has longitudinal members 110 comprising rigging attachment members 150. In a preferable embodiment, first ends of rigging lines 220 are attached to the rigging attachment members 150 while the other ends are attached to connectors 210. Rigging lines 220 are preferably wire rope slings. Connectors 210 preferably comprise a plurality of apertures through which shackles 300 may be directly attached. A preferable connector 210 is a tri-link connector. Some shackles 300, in turn, are preferably attached to rigging lines 210 or, alternatively, to lines attached to a crane hook.

Another embodiment is a spreader bar assembly having a longitudinal member and a plurality of adjustable support members variably attached along the length of the longitudinal member.

The embodiments shown in the drawings and described above are exemplary of numerous embodiments that may be made within the scope of the appended claims. It is contemplated that numerous other configurations may be used, and the material of each component may be selected from numerous materials other than those specifically disclosed. In short, it is the applicant's intention that the scope of the patent issuing herefrom will be limited only by the scope of the appended claims.

PARTS LIST

100 Spreader bar assembly
110 Longitudinal member
120 Cross member
130 Frame
131 Base of frame
132 Arm of frame
133 Bar member of frame
134 Aperture of frame
135 Base aperture
136 Peg
137 Slot
140 Support line
141 Free end of a support line
150 Rigging attachment member
160 Sleeve
200 Overhead rigging
210 Connector
220 Rigging line
300 Shackle
400 Load
420 Center of gravity of load

What is claimed is:

1. A spreader bar assembly comprising:
a. at least two longitudinal members having a length;
b. a plurality of cross members, each cross member attached to at least two longitudinal members, and wherein the two longitudinal members and plurality of cross members are positioned in substantially the same plane; and
c. a plurality of frames slidably attached along the length of the longitudinal members; and
d. at least one frame comprising a U-shaped member comprising a base and two arms; and
e. the at least one frame further comprising at least one bar member attached to the arms and an aperture enclosed by the bar member, arms, and base.

2. The spreader bar assembly of claim 1, wherein the longitudinal members are I-beams.

3. The spreader bar assembly of claim 1, wherein the longitudinal members comprise sleeves and the cross members engage the longitudinal members through the sleeves.

4. The spreader bar assembly of claim 1, wherein the cross members have a tubular cross-section.

5. The spreader bar assembly of claim 1, wherein the support members are directly attached to a shackle and each shackle is attached to a support line.

6. The spreader bar assembly of claim 1, wherein the base of the frames further comprise an aperture.

7. The spreader bar assembly of claim 1, wherein the longitudinal member has a cross-section having a height and width and wherein the frame aperture has a height and width that is equal to or greater than the height and width of the cross-section of the longitudinal member.

8. The spreader bar assembly of claim 1, further comprising at least one support line attached to each support member and wherein the support lines are endless slings.

9. The spreader bar assembly of claim 1, further comprising at least one support line attached to each support member and wherein at least four support lines are attached to a load.

10. The spreader bar assembly of claim 9, wherein the load has a length and the length of the longitudinal members is different than the length of the load.

11. The spreader bar assembly of claim 1, wherein the longitudinal members further comprise a plurality of rigging attachment members.

12. The spreader bar assembly of claim 11, further comprising an overhead rigging, the overhead rigging comprising a plurality of rigging lines having a first end attached to the rigging attachment members.

13. The spreader bar assembly of claim 12, wherein the rigging lines are wire rope slings.

14. The spreader bar assembly of claim 12, wherein the rigging lines are attached to one or more connectors at a second end.

15. The spreader bar assembly of claim 14, wherein the connectors are tri-link connectors.

16. The spreader bar assembly of claim 14, wherein the connectors are directly attached to one or more shackles, and at least one shackle is attached to the second ends of one or more rigging lines.

17. The spreader bar assembly of claim 1 further comprising a load selected from the group consisting of: (i) a pipe rack; (ii) a building module; and (iii) a cargo container.

18. The spreader bar assembly of claim 17, wherein the load is substantially rectangular.

19. A spreader bar assembly comprising:
a. at least two longitudinal members having a length;
b. a plurality of cross members, each cross member attaching to at least two longitudinal members, and wherein the two longitudinal members and plurality of cross members are positioned in substantially the same plane;
c. a plurality of support means adjustably positioned along the length of the longitudinal members; and
d. wherein the support means comprise a U-shaped member having a base and two arms.

20. The spreader bar assembly of claim 19, wherein the support means are frames slidably attached to the longitudinal members.

21. The spreader bar assembly of claim 19, wherein the support means further comprise one or more bar members directly attached to the arms of the U-shaped member and the support means thereby further comprising an aperture enclosed by the bar members, arms, and base.

22. A method of moving a load with a crane comprising the steps of:

a. providing one crane and a load having an asymmetrical center of gravity;

b. attaching a crane hook to a spreader bar assembly comprising a plurality of support members, at least one support member attached to a support line, wherein at least one support member comprises:

i. a base and two arms;

ii. at least one bar member attached to the arms; and iii. an aperture enclosed by the bar member, arms, and base;

c. positioning the crane hook above the load and positioning the crane hook substantially vertically above the center of gravity;

d. attaching a free end of at least one support line to the load; and e. adjusting the support members such that the support lines are substantially vertical with respect to the load.

23. The method of claim 22, wherein a sacrificial sling is positioned under the load and attached to the support lines.

24. The method of claim 22, wherein the spreader bar assembly is suspended from a single crane.

25. The method of claim 22, wherein the spreader bar assembly further comprises at least one longitudinal member and the support members are adjustably attached to the longitudinal member.

26. The method of claim 22, wherein at least one support member is slidably attached to a longitudinal member.

27. The method of claim 22, wherein at least one support member comprises a U-shaped member having a base and two arms.

28. The method of claim 22, wherein a base of at least one support members further comprises an aperture.

* * * * *